United States Patent [19]

Andörfer

[11] Patent Number: 4,582,533

[45] Date of Patent: Apr. 15, 1986

[54] METHOD OF AND PREALLOY FOR THE PRODUCTION OF TITANIUM ALLOYS

[75] Inventor: Hermann Andörfer, Fürth, Fed. Rep. of Germany

[73] Assignee: Fe Gesellschaft fur Elektrometallurgie mbH, Dusseldorf, Fed. Rep. of Germany

[21] Appl. No.: 621,039

[22] Filed: Jun. 15, 1984

[30] Foreign Application Priority Data

Mar. 16, 1984 [DE] Fed. Rep. of Germany ..... 3409616

[51] Int. Cl.[4] ..... C22B 4/00

[52] U.S. Cl. ..... 75/10 V; 75/10 R; 75/49

[58] Field of Search ..... 75/10 R, 10 V, 49

[56] References Cited

U.S. PATENT DOCUMENTS

| | | | |
|---|---|---|---|
| 2,640,860 | 6/1953 | Herres | 75/10 R |
| 3,005,246 | 10/1961 | Murphy | 75/10 R |
| 4,119,457 | 10/1978 | Perfect | 420/580 |

OTHER PUBLICATIONS

Aerospace Material Specification/AMS 4975B, "Titanium Alloy Bars and Rings," by Society of Automotive Engineers, Inc., 1971, pp. 1–7.

Aerospace Material Specification/AMS 4976A, "Titanium Alloy Forgings," by Society of Automotive Engineers, Inc., 1978, pp. 1–7.

Metallwissenschaft und Technik/METALL, Jun. 1982, pp. 659–668, Dr. K. H. Kramer, Krupp Stahl AG.

*Primary Examiner*—Peter D. Rosenberg

*Attorney, Agent, or Firm*—Karl F. Ross; Herbert Dubno

[57] ABSTRACT

A masteralloy of the following composition:

13 to 15% by weight tin,
27 to 29% by weight zirconium,
13 to 15% by weight molybdenum,
up to 0.6% by weight silicon, less than 0.5% by weight unavoidable impurities and balance aluminum is produced and utilized as a melting electrode in the vacuum-electric-arc production of titanium alloys to produce an alloy containing the elements of the masteralloy in substantially the same weight relationships and with substantial freedom from oxides and nitride inclusions. The titanium alloys which result are particularly effective for aerospace use.

10 Claims, No Drawings

METHOD OF AND PREALLOY FOR THE PRODUCTION OF TITANIUM ALLOYS

CROSS REFERENCE TO RELATED APPLICATIONS

This application is related to the commonly assigned concurrently filed copending applications Ser. No. 621,040 based upon German application P 34 09 615.9 filed Mar. 16, 1984 and Ser. No. 621,046 based upon German application No. P 34 09 614.0 filed Mar. 16, 1984.

FIELD OF THE INVENTION

The present invention relates to the production of titanium alloys and, specifically to the production of titanium alloys in which apart from titanium, the alloy contains tin (Sn), zirconium (Zr), molybdenum (Mo) and aluminum (Al), utilizing a masteralloy. More specifically, the invention relates to the use of such a masteralloy, a masteralloy of novel composition and a method of making the titanium alloy utilizing the masteralloy, as well as to the production of the masteralloy for use in the latter method.

BACKGROUND OF THE INVENTION

The production of highly specialized titanium alloys and especially titanium alloys utilized primarily for aircraft and spacecraft purposes, particularly the alloys Ti-6Al-2Sn-4Zr-2Mo and Ti-6Al-2Sn-4ZR-2Mo-0.1Si are known and indeed are described in the *Aerospace Material Specifications* (Society of Automotive Engineers ) AMS 4975B (1968) and AMS 4976A (1968).

Such titanium alloys are especially desirable because they can be subjected to extreme conditions in use.

However, the quality of these alloys is strictly determined by the ratios of the respective alloying elements to one another and by the purity of the product so that the fabrication of such titanium alloys has posed problems heretofore.

Titanium alloys of this composition have been produced in the past by combining titanium sponge with a two-component or binary masteralloy, for example, composed of aluminum and molybdenum with metallic components such as zirconium (as zirconium sponge) and tin.

The mixture is worked up into consumable electrodes which are melted into the bath in a vacuum-electric-arc furnace in which the consumable electrode contributes the alloying elements to the titanium melt. The alloy melt is then cast into ingots.

Frequent remelting is required to ensure a sufficient homogeneity of the solid titanium alloy product thus produced (see Metall, vol. 36, pp 659 ff, 1982).

It is known to produce titanium alloys utilizing masteralloys which contain, apart from aluminum, the elements zirconium, molybdenum, titanium and a variety of impurities. These known masteralloys, however, do not cover the entire range of interesting and important titanium alloys with respect to the alloying elements. As a consequence, it has been necessary heretofore, especially for the production of the titanium alloys mentioned first above, to add further elements as alloying ingredients. The alloying elements in the masteralloy generally cannot be found in their ratio in the masteralloy or composition, in the titanium alloy which is produced.

The masteralloy may be formed aluminothermically (German open application DE-OS No. 28 21 406).

I have found that these earlier methods and masteralloys were incapable of producing final titanium alloys of the preferred composition in accordance with the cited *Aerospace Material Specifications,* for example, Ti-6Al-2Sn-4Zr-2Mo and Ti-6Al-2Sn-4Zr-2Mo-0.1Si.

Especially noteworthy with respect to the defects of the prior art systems were the tendency toward high nitride inclusions, the tendency for incorporation of oxygen into the titanium alloys and the formation of oxide inclusions.

OBJECTS OF THE INVENTION

It is the principal object of the present invention to provide an improved method of making titanium alloys with a substantially predetermined relationship of at least several of the alloying ingredients and especially titanium alloys containing aluminum, tin, zirconium and molybdenum as alloying ingredients whereby the disadvantages of earlier methods are obviated and alloys of high purity and freedom from nitride inclusions and with low oxygen contents can be formed.

Another object of the invention is to provide an improved use for an aluminum, tin, zirconium, molybdenum composition.

It is another object of this invention to provide an improved masteralloy capable of producing titanium alloys of higher quality and less variability than has heretofore been the case, especially for aerospace applications.

It is a further object of this invention to provide an improved method of making such new masteralloys.

SUMMARY OF THE INVENTION

These objects and others which will become apparent hereinafter are attained, in accordance with the present invention, through the use of a masteralloy having the following compositional analysis:

13 to 15% by weight tin
27 to 29% by weight zirconium
13 to 15% by weight molybdenum
up to 0.5% total unavoidable impurities balance aluminum as a masteralloy for the production of a titanium alloy which will contain, in addition to titanium, aluminum, tin, zirconium and molybdenum, in a vacuum-electric-arc furnace in which the masteralloy forms a consumable melting electrode and in which, during the melting and subsequent casting process, the ratio in weight percent of all of the elements of the masteralloy is maintained in the titanium alloy which is produced.

The aluminum content of the masteralloy should be such, with respect to the other alloying components and the impurities, to make up 100%. It is self-evident that in the use of the masteralloy in accordance with the teachings of the invention, the usual mixing laws are observed. It will be understood further that small corrections can be made in the amounts of the alloying elements found in the ultimate titanium alloy by appropriate additions of respective elements without detriment to the overall results.

For the production of a titanium alloy which apart from titanium and the alloying elements Al, Sn, Zr and Mo, also should contain Si, I add to the masteralloy Si in an amount of 0.5 to 0.6% by weight and in the ratio in which Si is to appear in the titanium alloy with respect to the other alloying elements.

Utilizing the principles of the invention, I have found that it is possible to establish the quantities of the elements in the masteralloy (including aluminum) so that it has a melting point which lies below that of titanium so that the prealloy readily melts in the vacuum-electric-arc furnace as the titanium melt is formed and produces an extremely homogeneous composition by intimately mixing with the titanium. The masteralloy generally has a homogeneous composition itself and a uniform grain size as well as a melting point of 1400° to 1450° C., all of which contribute to an intimate blending and distribution of the alloying elements in the melt and hence the formation of a titanium alloy which does not require repeated remelting upon casting.

To produce titanium alloys, with an especially low gas content, I prefer to utilize a prealloy which itself has a comparatively low gas content, specifically a nitrogen content of 0.001 to 0.005% by weight and an oxygen content of 0.04 to 0.06% by weight, although lower nitrogen and oxygen levels may be provided.

I have found that, to obtain such low gas inclusions in the masteralloy, it is imperative to produce the prealloy itself in a two-step process wherein, in the first stage, an intermediate alloy of molybdenum and aluminum is formed from the elemental starting materials aluminothermically, with an aluminum content of at least 15%. This intermediate alloy and the other elements of the masteralloy, including any additional aluminum which may be required, is then smelted in a vacuum induction furnace, degassed and freed from aluminum-oxide inclusions. Preferably the masteralloy is smelted in a crucible of $Al_2O_3$/MgO/spinel.

The degassing is carried out with agitation and stirring of the bath by the interaction with the magnetic field under the induction-furnace conditions at a smelting temperature of about 1400° C. with the masteralloy melt being maintained liquid until aluminum-oxide inclusions separate out as a layer on the bath which is removed.

One of the advantages of the invention is that, by the use of the masteralloy described, it is possible to produce titanium alloys containing the alloying ingredients of the masteralloy with at least some and generally all of these alloying elements in the titanium alloy in practically precise relative proportions which are all the same as those of these elements in the masteralloy, while nevertheless ensuring that the titanium alloy which results is practically free from impurities and especially nitrogen and has no detrimental level of nitrides.

SPECIFIC EXAMPLE

A vacuum induction furnace is charged with:

7.02 kg MoAl—(72.22% Mo),
12.88 kg Al granules—(99.7% Al),
4.80 kg Sn metal—(99.9% Sn),
9.72 kg Zr metal—(99.0% Zr).

The mixture is smelted, degassed and maintained liquid with induction agitation for ½ hour and the temperature of the bath is then set at 1450° C. The bath is cast into molds at 1450° C. under an argon protective atmosphere and the cast electrodes are cooled for 2 hours in an argon atmosphere at a pressure of 200 torr. 34.4 kg Al-Sn-Zr-Mo electrode with the alloying ingredients in the appropriate weight proportions 6-2-4-2 was obtained (in the form of a melting electrode) of the following weight composition:

42.1% Al—0.007% C,
14.8% Sn—0.002% B,
28.15% Zr—0.002% W,
14.6% Mo—0.003% Pb,
0.08% Fe—0.06% O,
0.04% Si—0.001% N.

By the addition of silicon metal (99.7% silicon), the silicon content of the alloy can be set at any controlled value desired. The silicon in this case is added during the vacuum smelting. The addition of 0.19 kg Si metal in the above case provided 0.56% Si in the composition.

Utlizing this melting electrode in a vacuum-electric-arc furnace for the production of titanium alloys (see Metall, Op. Cit.), titanium alloy Ti-6Al-2Sn-4Zr-2Mo or Ti-6Al-2Sn-4ZR-2Mo-0.1Si in accordance with AMS 4975B (1968) or AMS 4976A (1968) are produced with high purity and without any detrimental oxygen content or nitride inclusions.

In the production of the masteralloy, an intermediate molybdenum-aluminum alloy is produced in a first stage by aluminothermal reduction in a burn-off or thermite-type vessel. To this end, molybdenum (VI) oxide (greater than 99.9% $MoO_3$) is mixed with aluminum at a purity of 99.8% Al, intimately, in the reaction flask and ignited. The exothermic reaction guarantees complete separation of the intermediate alloy metal from the corundum slag. Fluxing agents for reducing the viscosity of the slag are not necessary. This is advantageous since the advantage of a fluxing agent opens the door to the introduction of impurities into the intermediate alloy. The amount of aluminum used is somewhat in excess over that required for the reduction such that the intermediate alloy consists of 72 to 75% by weight molybdenum and 25 to 28% by weight aluminum. The MoAl 75:25 alloy is cast into ingots weighing up to 500 kg.

The second stage of the process involves the smelting of the high purity MoAl 75:25 with additional aluminum (99.7% Al), zirconium metal and pure tin (if desired also Si) under vacuum in the crucible.

After degassing, the bath can be maintained for a comparatively long period under an argon-productive atmosphere and subjected to inductive stirring to ensure complete separation of $Al_2O_3$ inclusions. This movement of the bath also ensures an optimum homogeneity. The overall smelting process is easily controlled with precision, especially with respect to the smelting temperature and overheating by aluminothermal reactions are avoided. There is no reduction during this second stage and any tendency toward any such reduction reactions should be precluded. The casting is effected in the steel-ingot molds under an argon-protective atmosphere at 100 torr pressure with cooling, as described, under 200 torr argon. The melting electrode may be cast directly in this final form in this manner or the ingots which are cast can be comminuted and worked up into working electrodes, as desired.

I claim:

1. A method of making a titanium alloy containing titanium and, as alloying elements, tin, zirconium, molybdenum and aluminum, said method comprising the steps of:

(a) forming a masteralloy of the following composition:

13 to 15% by weight tin,
27 to 29% by weight zirconium,
13 to 15% by weight molybdenum,
up to 0.6% by weight silicon,
less than 0.5% by weight unavoidable impurities, and balance aluminum;

(b) forming a melting electrode from said masteralloy; and (c) melting titanium in a vacuum-electric-arc furnace utilizing said melting electrode to melt the titanium to form a titanium alloy melt and casting said melt to form a titanium alloy containing all of said elements as alloying elements of the titanium alloy and at least some of said elements in relative proportions in the titanium alloy corresponding to their relative proportions by weight in said masteralloy.

2. The method defined in claim 1 wherein said masteralloy is formed with 0.5 to 0.6% by weight silicon.

3. The method defined in claim 1 wherein said masteralloy is produced in step a with selection of said elements such that such masteralloy has a melting point below that of titanium.

4. The method defined in claim 1 wherein the masteralloy is made in step a in two steps including a first step in which an intermediate alloy of molybdenum and aluminum is itself made aluminothermally from the respective elements with an aluminum content of at least 15% by weight and said intermediate alloy is then combined with the other elements of said prealloy and any additional aluminum required in a vacuum induction oven to form a melt which is degassed and freed from aluminum oxide inclusions.

5. The method defined in claim 4 wherein the last mentioned melt is formed in an $Al_2O_3$/MgO/spinel crucible and is maintained under induction agitation after degassing in a liquid state for separation of aluminum oxide therefrom.

6. In a method of producing a titanium alloy where titanium is melted, the improvement wherein the titanium alloy is found by vacuum-electric-arc melting in a vacuum electric-arc furnace using as a melting electrode a masteralloy of the following compositional analysis:

13 to 15% by weight tin,
27 to 29% by weight zirconium,
13 to 15% by weight molybdenum,
up to 0.6% by weight silicon, up to 0.5% by weight unavoidable impurities and the balance aluminum to a titanium alloy containing tin, zirconium, molybdenum and aluminum such that the alloying elements in the titanium alloy apart from the titanium maintain their weight ratios as they were in the masteralloy.

7. The improvement defined in claim 6 wherein said masteralloy is formed with 0.5 to 0.6% by weight silicon.

8. The improvement according to claim 6 wherein the elements including aluminum in the masteralloy are selected so that the prealloy has a melting point less than that of titanium.

9. A method of making the electrode defined in claim 1 comprising preparing an intermediate alloy of molybdenum and aluminum made aluminothermally from the respective elements with an aluminum content of at least 15% by weight and combining said intermediate alloy with the other elements of said masteralloy and any additional aluminum required in a vacuum induction oven to form a melt which is degassed and freed from aluminum oxide inclusions.

10. The method defined in claim 9 wherein the last mentioned melt is formed in an $Al_2O_3$/MgO/spinel crucible and is maintained under induction agitation after degassing in a liquid state for separation of aluminum oxide therefrom.

* * * * *